US005176535A

United States Patent [19]

Redmond et al.

[11] Patent Number: 5,176,535

[45] Date of Patent: Jan. 5, 1993

[54] ELECTRICAL CONNECTOR AND CABLE UTILIZING SPRING GRADE WIRE

[75] Inventors: John P. Redmond, Mechanicsburg; Ray N. Shaak, Lebanon, both of Pa.

[73] Assignee: AMP Incorporated, Harrisburg, Pa.

[21] Appl. No.: 841,854

[22] Filed: Feb. 26, 1992

Related U.S. Application Data

[60] Continuation of Ser. No. 655,002, Feb. 14, 1991, abandoned, which is a division of Ser. No. 530,666, May 30, 1990, Pat. No. 5,015,197.

[51] Int. Cl.[5] ..... H01R 9/07

[52] U.S. Cl. ..... 439/495; 439/499; 174/117 M

[58] Field of Search ..... 439/492, 493, 495, 499, 439/596, 595, 329, 930, 660, 676, 77, 78; 174/117 F, 117 M, 117 FF, 268

[56] References Cited

U.S. PATENT DOCUMENTS

| | | | |
|---|---|---|---|
| 1,012,030 | 11/1908 | Underwood . | |
| 3,197,555 | 7/1965 | Mittler | 174/268 |
| 3,371,250 | 3/1966 | Ross et al. | 317/101 |
| 3,447,120 | 6/1967 | Rask et al. . | |
| 3,639,978 | 2/1972 | Schurman | 29/628 |
| 3,711,627 | 1/1973 | Maringulov | 439/268 X |
| 3,736,366 | 5/1973 | Henberg | 174/34 |
| 4,310,208 | 1/1982 | Webster et al. | 439/494 |
| 4,470,195 | 9/1984 | Lang | 29/825 |
| 4,518,648 | 5/1985 | Miyata et al. | 428/256 |
| 4,616,717 | 10/1986 | Luetzow | 174/117 F |
| 4,639,054 | 1/1987 | Kersbergen . | |
| 4,651,163 | 3/1987 | Sutera et al. | 346/75 |
| 4,682,828 | 7/1987 | Piper et al. | 439/92 |
| 4,741,707 | 5/1988 | Mondor, III | 439/417 |
| 4,755,422 | 7/1988 | Headrick et al. | 428/256 |
| 4,929,803 | 5/1990 | Yoshida et al. | 174/117 M |
| 4,940,426 | 7/1990 | Redmond et al. | 439/495 |

*Primary Examiner*—Paula A. Bradley
*Assistant Examiner*—Khiem Nguyen

[57] ABSTRACT

An electrical connector 63 includes at least one length of wire 54 having an insulating means 55 with at least one portion 58 of the wire 54 extending free from the insulating means 55 and a housing 62 adapted to hold the free end 58 and a length of the insulating means relative to a first contact point 102 on an electrical article 100 to be interconnected with connector 63 to wire 54. Wire 54 includes one portion 56 inelastically deformed to provide a second contact point 60 adapted to engage said first contact point 102. Housing 62 includes portions adapted to position the second contact point 60 in bearing relationsip with the first contact point 102 with the spring beam 56 being deflected to provide a normal force engagement between the first and second 102, 60 contact points sufficient to assure a stable, low resistance interface.

2 Claims, 6 Drawing Sheets

ELECTRICAL CONNECTOR AND CABLE UTILIZING SPRING GRADE WIRE

This application is a continuation of application Ser. No. 07/655,002 filed Feb. 14, 1991, now abandoned, which in turn is a division of application Ser. No. 07/530,666 filed May 30, 1990, now U.S. Pat. No. 5,015,197.

This invention relates to an electrical connector and cable wherein the interconnection portions of the connector are formed to define spring beams and the wire of the cable is integral with such portions. This application is related to U.S. Patent No. 4,940,426 in the names of J. P. Redmond and R. Shaak.

BACKGROUND OF THE INVENTION

Electronic packaging has grown smaller with the advent of integrated circuits that feature a high density, close center line use of input and output interfaces. The trend to smaller devices itself impacts on the design of components that interconnect such devices to the various levels of packaging from chip to chip package, from chip package to daughter board, from daughter board to mother board, and from mother board to the outside world of functioning devices associated with computers, communication circuits, and the like. Center line spacing in these various packages has dropped from 0.250 inches to 0.100 inches over the last decade and now center line spacings of less than 0.050 inches and indeed less than 0.030 inches are being employed. In fact, the inability to design terminals and connectors to interconnect directly on integrated circuit path centers has created a problem expressed in terms of signal distortion, impedance mismatch causing such distortion, and particularly with respect to the manufacture, assembly and use of very small plastic and metal parts needed to define interconnection systems wherein the center lines are appreciably under 0.030 inches.

The foregoing problems manifest themselves with respect to the higher level interconnections in very specific ways. For example, electrical terminals which are typically stamped and formed to be joined to wires as by crimping, I.D.C. (insulation displacement connectors), solder and the like must, in order to be small, require exceedingly small dies operating on very thin metal stock, necessitating special handling in plating, reeling in strip form or special packaging in loose piece form. Moreover, the very small terminals, which are quite delicate and fragile, must be joined to very small wires as by the above-mentioned terminating processes, all necessitating fine precision parts and great skill in handling. The foregoing problem becomes even more difficult in the lower levels of interconnection wherein the center-to-center spacing is even smaller and the interconnection parts are smaller still. This smallness is further complicated when interconnection paths must be utilized in multiple or large line counts where center line distances may need to be on the order of 0.004 to 0.010 inch.

The present invention has as an object the provision of an interconnection system capable of being utilized on fine center distances such as on the order of 0.004 to 0.030 inches for terminals, cable, connectors, and interconnections. The invention has as a further object the provision of a simple and relatively low cost interconnection system that integrates terminal and cable to thus provide an improved electrical characteristic for components and harness units made of such integrated product. The invention has as a still further object the provision of connectors formed on fine centers and of cable formed on fine centers wherein the constituent parts are integral and have characteristics desirable for electrical interconnection.

SUMMARY OF THE INVENTION

The present invention utilizes very small diameter wire formed of spring grade material with portions thereof deformed to define spring deflection arms carrying contact points for interconnection with further contact points as for example the conductive pads, posts, pins, tabs carried by printed circuit boards or other electrical devices. The wire is deformed at one or both ends or periodically along its length with the deformed portions carried in a housing adapted to establish and maintain the wire in deflection to generate a stable normal force through the deflection of the wire bringing such contact points into engagement to define a low resistance electrical path. The invention contemplates the wire being plated at the contact points thereof selectively or all along the length of the wire. The invention contemplates multiple wires being selectively deformed to define spring beams where needed with the remainder of the wire being relatively straight and woven with plastic filaments to maintain the wire on desired centers along its length. Alternatively, the wire may be deformed periodically along its length with plastic filaments fitted between the bends of the wire to hold such wire on centers. In other words, the wire may be the warp or the woof in construction with the plastic filaments forming the complementary woof or warp for a multi-wire unit. The resulting woven assembly may, in certain instances, be further bonded as by the casting of a plastic material therethrough, or laminated, or made to contain an extruded covering thereover in several embodiments.

The invention contemplates utilizing long lengths of the assembled wire of the invention for interconnections with the ends or selective portions in the middle of the cable being employed by virtue of deformation of the wire to define interfaces. In certain types of packages, the invention contemplates special housings designed to hold the deformed beam sections of the wire in position to effect sound electrical interconnections.

IN THE DRAWINGS

DETAILED DESCRIPTION OF THE INVENTION

Figure 1:
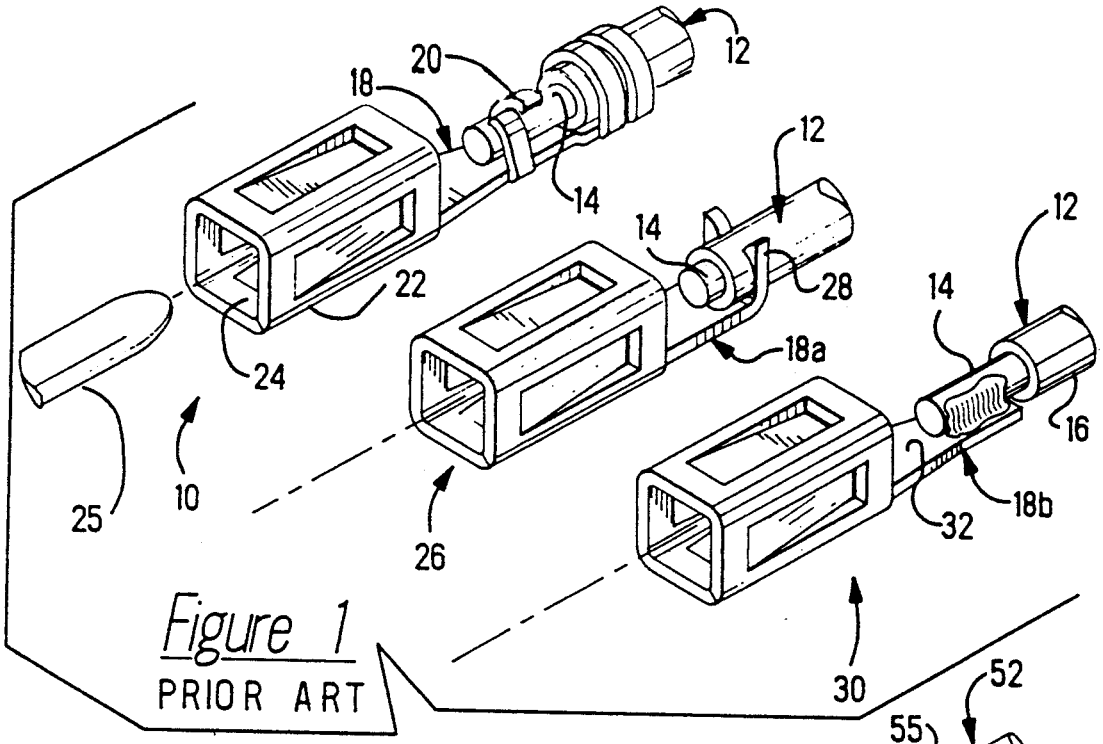
Figure 1 PRIOR ART
FIG. 1 is a perspective view, considerably enlarged from actual size of three types of interconnections in accordance with the prior art.

Referring now to FIG. 1, three types of connectors are shown, a crimp-type 10, an I.D.C. version 26, and a solder-type 30. Each connects a lead 12 comprised of a center conductive wire 14 surrounded by an insulation 16 to a terminal. The terminal body 18 includes, with respect to the crimp-type connector, a crimp barrel 20 inelastically deformed against a wire 14 and a forward box portion 22 defining a cavity 24 into which a post or pin 25 is inserted to effect an interconnection. With respect to the I.D.C. version 26, the terminal body 18*a* includes at the rear end a turned up V slot 28 into which the wire 12 is forced with the V slot stripping the insulation and deforming wire 14. The terminal body 18*b* of solder version 30 includes a tab 32 having the wire 14 thereof soldered to a surface thereof. Central to these various kinds of prior art devices is the understanding that each of the interfaces between wire and connector body represents a finite resistance which, if the interconnection is done properly, will be stable and of low value. Each of the connectors has a certain width defined by the necessary structure to perform mating or latching functions with connector housings and in general the width or height or cross-sectional profiles are many times the profile of the wire 12 and such profiles in essence define the center-to-center spacings of such connectors. Because of this fact, connectors such as those shown in FIG. 1 are frequently staggered with two or four or more rows which allows room for multiple interconnections in a side to side manner but nevertheless takes up depth in terms of mating to printed circuit boards and the like.

Figure 2:
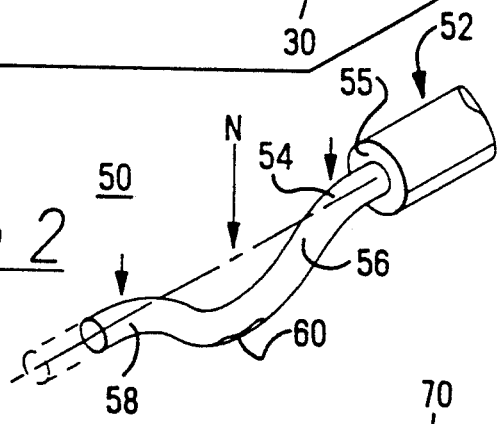
FIG. 2 is a perspective view of the invention, wire, and connector, also considerably enlarged from actual size.

Referring now to FIG. 2, an electrical connector 50 is comprised of a length of lead 52 including a central core wire 54 surrounded by an insulating coating 55. The wire 54 has been formed to include a beam section 56 ending in an extending portion 58 and carrying an area of selective plating 60 on the bottom thereof. The dotted line shown with respect to 50 indicates the deformation which takes place to effectively interconnect area 60 with a mating contact point. It will be observed that there is no separate interface as between the lead and the beam portion of connector 50, as there is with respect to connectors 10, 26 and 30. In accordance with the invention, the wire 54 is formed of a spring grade material of a dimension and a conductivity suitable for the particular circuit application involved. The combination of higher impedances associated with integrated circuit devices and lower currents required for such devices allows the use of wire of spring grade characteristics but having a lesser conductivity than pure copper or copper alloys normally utilized with respect to wire and cable. The diameter of the wire 54 and the definition of the particular interface with respect to contact area 60 combine to define the beam section 56 required to generate a normal axes of the force, the force being denominated N necessary to assure a stable low resistance interface via 60.

Figure 4:
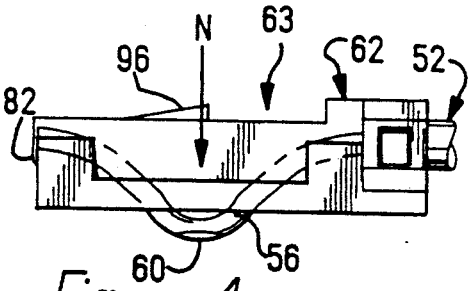
FIG. 4 is a side elevational view of the housing of FIG. 3 in a closed condition.
Figure 3:
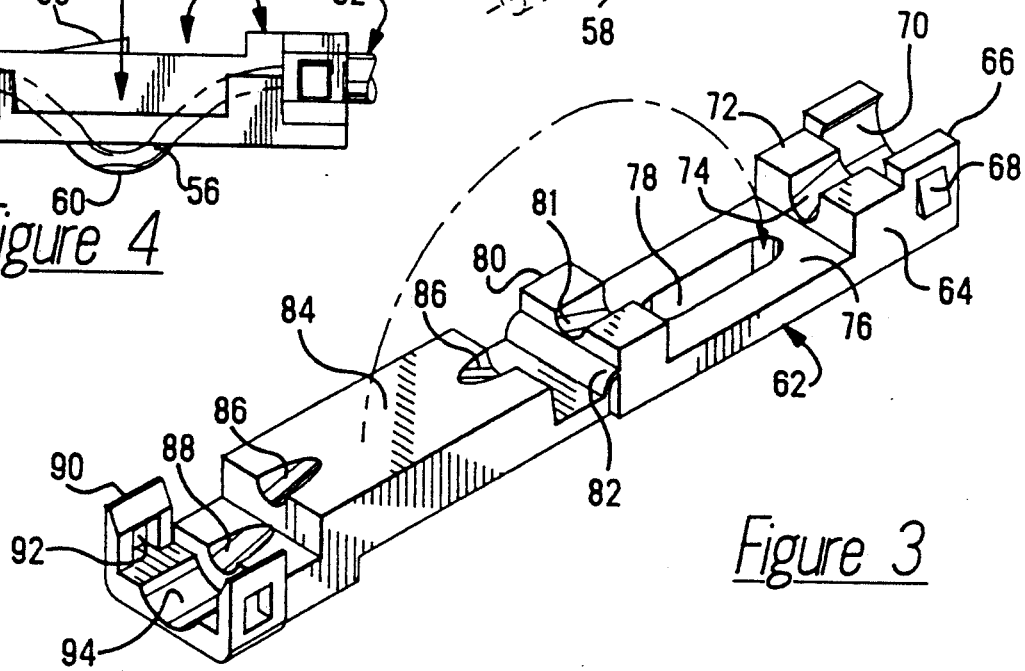
FIG. 3 is a perspective view of a plastic housing shaped to accommodate the connector of FIG. 2 and shown in an opened condition prior to installation of the wire therein.

FIG. 3 shows a plastic housing 62 which is typically molded of an engineering plastic having adequate dielectric properties to insulate and adequate structural properties to support the various portions of 50. The housing 62 is molded in an open condition to include a bottom portion 64 having at the end thereof an entry portion 66, and exterior portion 66, a pair of integrally formed latches 68, one of which is shown in FIG. 3 and the other being opposite thereto. Centrally formed in portion 66 is a cable receiving surface 70 dimensioned to tightly support the insulation 55 of lead 52 and forward thereof a wire support portion 72 grooved at 74 to receive the wire 54. Projecting forwardly of 72, 74 is a base section 76 apertured at 78 to receive the beam portion 56 of 50 inserted therethrough. The slot 78 facilitates displacement of 56 in a transverse sense up and down along the axis of normal force N but restricts sideways movement in the embodiment shown in FIGS. 3 and 4. Forward of 78 is a projection 80 also including a groove 81 to facilitate movement of the end portion 58 upon deflection of the beam portion 56. A hinge formed of the plastic shown as 82 interconnects a top portion 84 of the housing. The top portion includes interiorly relieved portions 86 facilitating movement of the beam portions 56. The groove 88 in the housing 62 cooperates with groove 74 to facilitate movement of end portion 58 within the housing upon deflection of the beam portion 56. The housing further includes a pair of latches 90 apertured at 92 to engage latching projections 68 when the housing is folded closed on 50. A curved surface 94 is provided to cooperate with surface 70 to clamp and support the wire lead 52. In FIG. 4 the contact surface 60, carried by the bight of the spring portion 56 can be seen protruding from the housing 62. The interior dimensioning of the housing is intended to clamp the insulation 55 of the wire and lightly clamp the wire 54 as it emerges from such insulation while leaving the beam portion 56 and the end portion 58 free for displacement relative to the housing along the axis indicated N. Also shown in FIG. 4 is a latch element 96 which extends from the top of housing 62.

Figure 5:
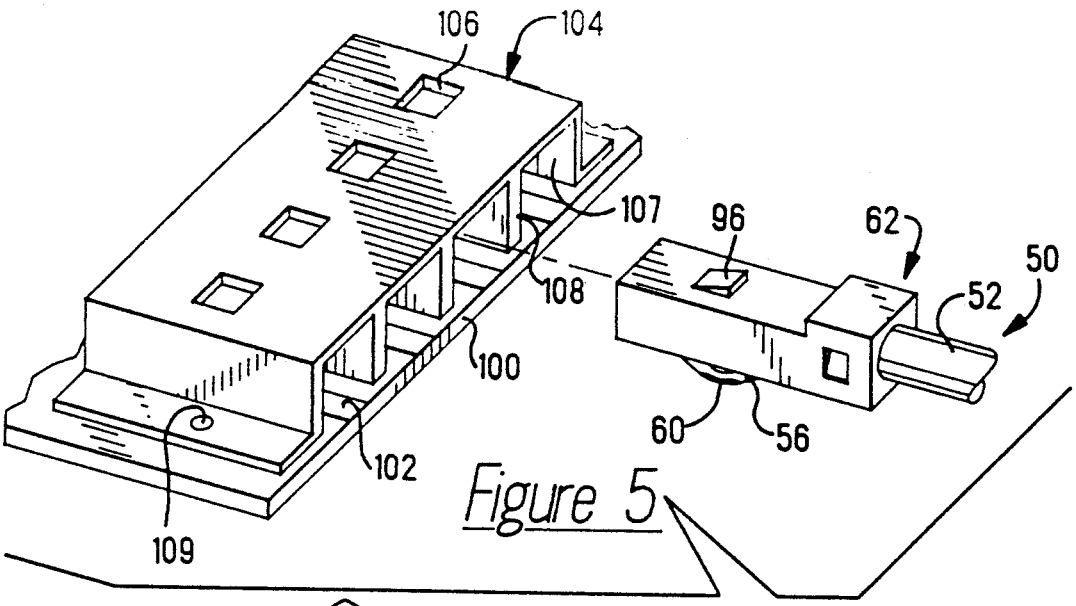
FIG. 5 is a perspective view of a mating connector preparatory to the insertion therein of the connector shown in FIG. 4.

With the housing folded and latched closed as shown in FIG. 4, the connector 63 formed thereby is ready for use in a mating receptacle wherein the contact area 60 can be brought into engagement with a further contact point to effect an interconnection. FIG. 5 shows a connector 63 comprised of elements 50 and 62 preparatory for insertion and interconnection with a printed circuit board 100 carrying thereon a series of conductive pads 102. Board 100 has fastened thereto a receptacle connector housing 104 formed as shown to include a plurality of recesses 106, one for each of a series of four cavities 107 defined by a plurality of upstanding walls 108. The connector housing 104 is fastened to board 100 as by fasteners 109 as shown in FIG. 5. The connector unit may be plugged into the connector housing 104 with the contact area 60 being brought into bearing engagement with a pad 102 and with the projection 96 of the terminal connector 63 latching within an aperture 106 to hold the terminal connector in place. Upon such insertion, the spring beam 56 will be deflected to maintain a normal contact force of bearing engagement between 60 and 102 adequate to form a low resistance path between the wire 54 and the printed circuit board path.

Figure 6:
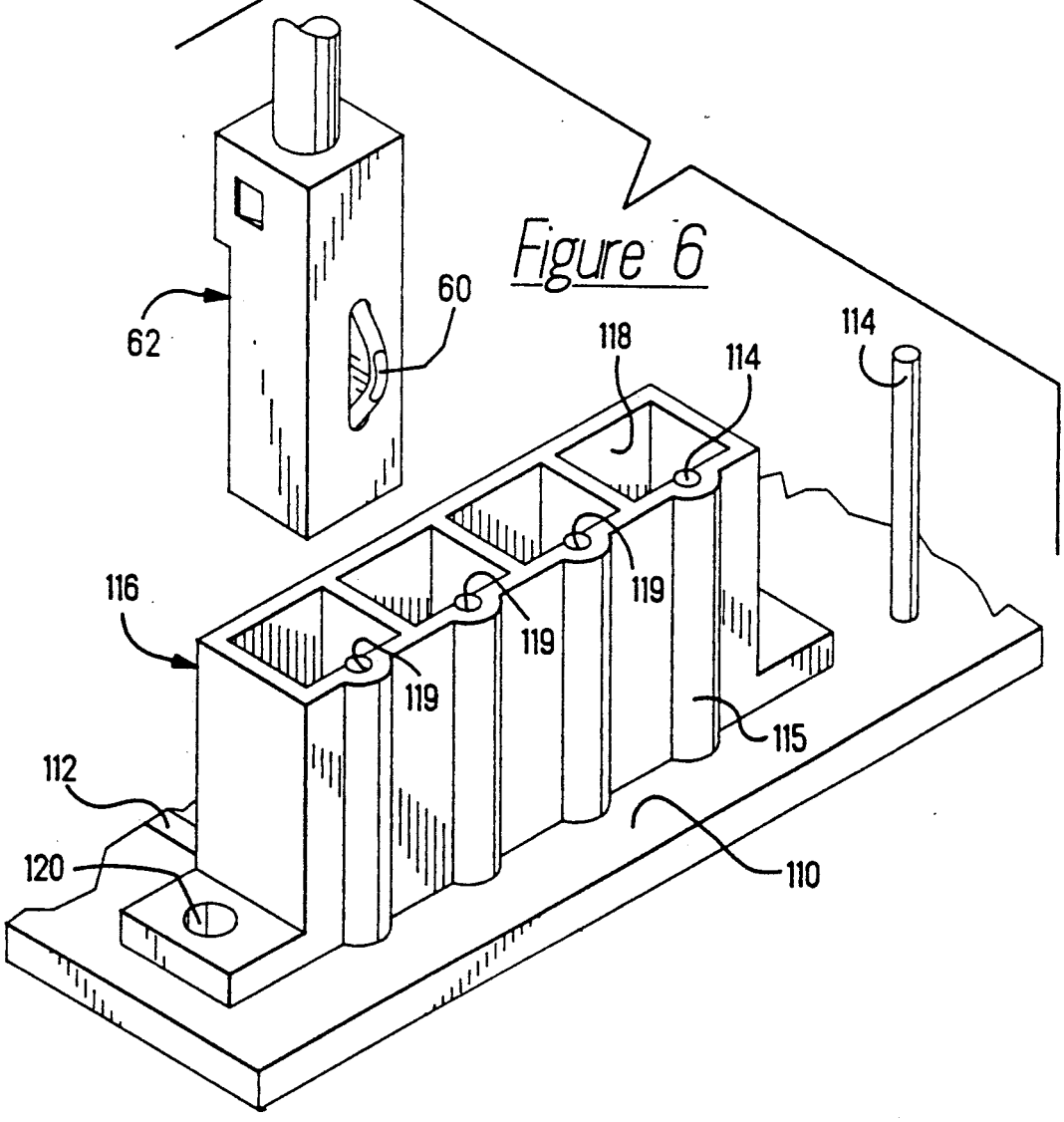
FIG. 6 is a perspective view showing an alternative embodiment of a connector preparatory to receiving the housing and connector of FIG. 4.

FIG. 6 shows an alternative version utilizing the terminal connector 63 shown in FIG. 4 in conjunction with the printed circuit board 110 having conductive paths 112 shown on the upper surface thereof, it being understood that conductive traces may be present within the board in a multi-layer construction or on the bottom of the board or in all three positions. These paths are interconnected by posts 114 which may be in the form of a variety of post and pin or tab shapes and soldered to the traces 112. Fitted over posts 114 is a housing 116 having a plurality of cavities 118 therein, and on one side thereof a series of grooves 119 that receive and position posts 114. The ends of housing 116 include fastening means 120 adapted to hold the housing in place on board 110. When a connector 63, including housing 62, is inserted within a cavity 118, the contact surface area 60 is made to engage the post 114 and deflect the spring section 56 to maintain a stable low resistance interface between the wire 54 and post 114. As can be discerned from FIG. 6, the center-to-center spacing possible is dependent upon the width of the housing 62 and the thickness of the dividing walls and end walls of housing 116. The width of housing 62 in turn is dependent upon the width of the plastic surrounding wire 54 and its insulation 55 shown in FIG. 2. In practice, wires as small as 0.003 inches in diameter having insulation coatings on the order of 0.001 inches may be utilized in housing on the order of 0.010 to 0.015 inches in width, making it quite feasible to provide connectors as shown in FIGS. 5 and 6 having center line spacing on the order of 0.025 to 0.030 inches.

Figure 7:
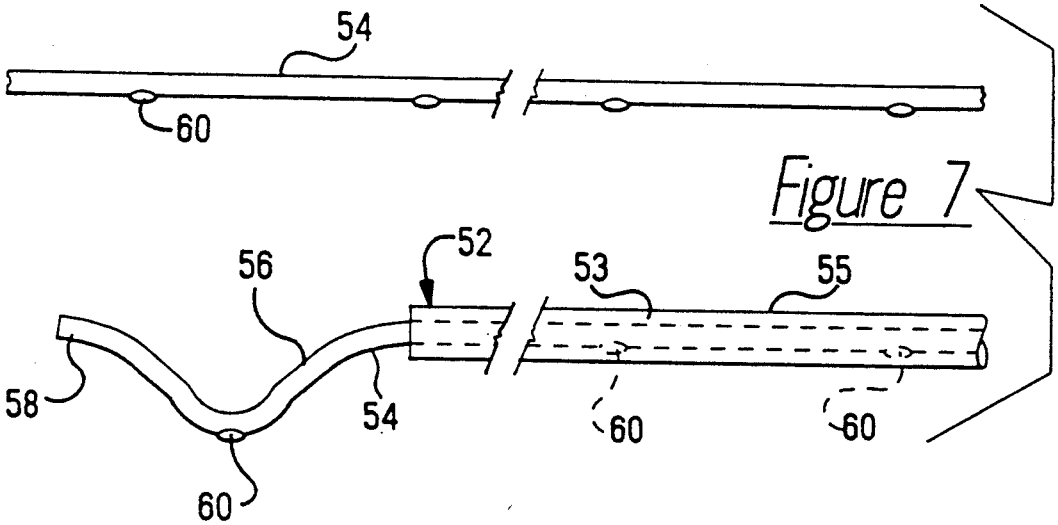
FIG. 7 shows a much enlarged longitudinal view of the wire of the invention, preparatory to deformation and following deformation at one end thereof to define a terminal.

Referring now to FIG. 7, a wire 54 has a series of contact areas 60 selectively and periodically spaced therealong. In this regard the invention contemplates the embodiment shown in FIG. 7 and also an embodiment wherein plating is provided along the entire length of 54 in accordance with the particular contact interface required. For example, it is contemplated that the wire 54 may be coated as by plating with a soft tin for interfacing with tin contact surfaces. There, the nature of the spring beam to be formed and the characteristics of the wire must be such as to generate a normal force adequate for a tin to tin interface. Such normal forces range from 200 to 300 or 400 grams. If the interface sought must, for reasons of use, be a precious metal, the contact surface may be formed by selectively plating the contact points 60 in a variety of ways, including the use of apertured belts which allow plating only through apertures proximate to the contact points. Another way for selective plating of the wire 54 would be to coat the wire with an insulating material and then remove selectively spots as at 60 as by abrasion or by etching or other means. In this way, plating at point 60 will occur and not along the rest of the wire. Also shown in FIG. 7 is a wire 54 formed as previously described with respect to FIG. 2 and made to have a relatively thick insulation coating 55, the coating out of diameter being on the order of three times a wire diameter. With respect to spring grade wire, a certain hardness of material is experienced, and in order to avoid fracture, particularly caused by undue bending radiuses experienced by the wire and added insulation may be provided as in FIG. 7 to increase the minimum bend radius of the insulated wire.

The invention contemplates a number of constructions for the insulating coating including a first porous or spongy coating as shown at 53 in FIG. 7 with an outside wrap 55 formed of an abrasion resistant thin film such as polyester or polyamide. This construction allows the wire to move slightly within the insulation during bending loads to minimize stress fracturing. The construction of the wire, including the insulation shown in FIG. 7, is contemplated particularly for uses of the invention wherein a single wire is employed to establish interfaces at one or both ends or in several contact points 60 along the length of the wire, the insulation being suitably stripped to expose contact points 60. It is contemplated that the wire may be marked exteriorly upon its insulating coating proximate to the contact points 60 to facilitate the location of such contact points. It is also contemplated that the wire may be utilized to form harness units with suitable lengths cut and stripped and then deformed to define the bend radiuses such as 56 at one or both ends or in the middle of the wire or elsewhere.

Figure 8:
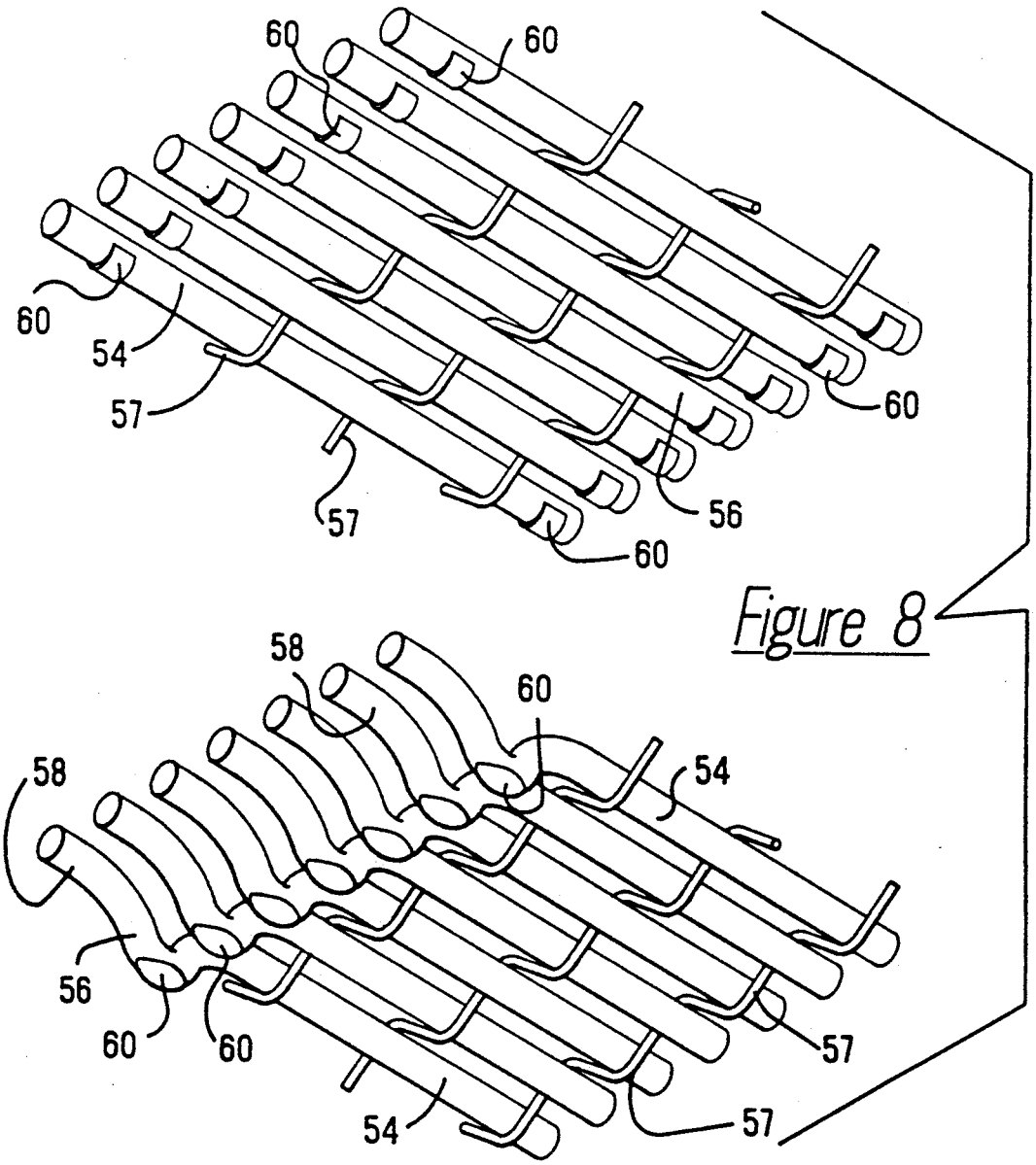
FIG. 8 is a perspective view of one form of the cable of the invention prior to and following deformation of an end thereof.

Referring now to FIG. 8, there is shown a use of the wire in cable form with seven wires 54 shown woven together through the use of a plastic filament 57. The left-hand version of the cable is shown with the wires straight forming in weaving terms a woof with the plastic filaments or fibers 57 forming the warp. The right-hand cable in FIG. 8 depicts the cable ends deformed to define spring beams 56, projecting contact points 60, and the wire ends 58.

Figure 9:
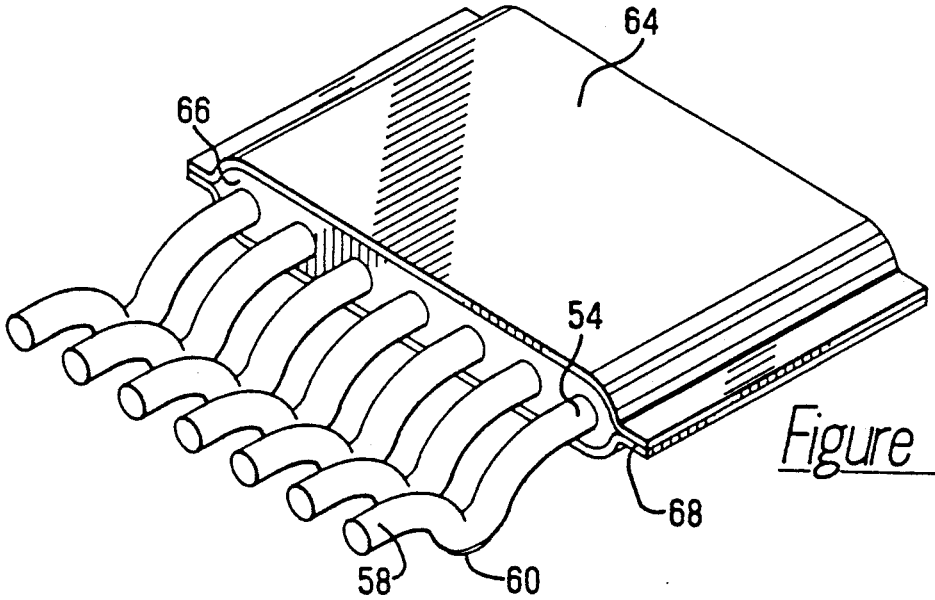
FIG. 9 is a perspective view of the end view of the cable of FIG. 8 having a laminated cover thereon.

FIG. 9 shows the cable of FIG. 8 having a protective covering 64 placed thereon, the covering 64 being formed by thin, abrasion resistant plastic film such as polyester suitably bonded to one or both sides of the cable. FIG. 9 further shows a porous or foam insulation 66 added to the cable and extending beneath the outer film layers 64. The film layers are bonded at the edges 68. A variety of alternative constructions are contemplated, including one wherein the cable in the form shown in FIG. 8 in an undeformed condition is coated with a soft pliable elastomeric material such as silicon and a thin film added to one side thereof, the silicon effectively bonding the wires 54 and filaments 57 together.

Figure 10:
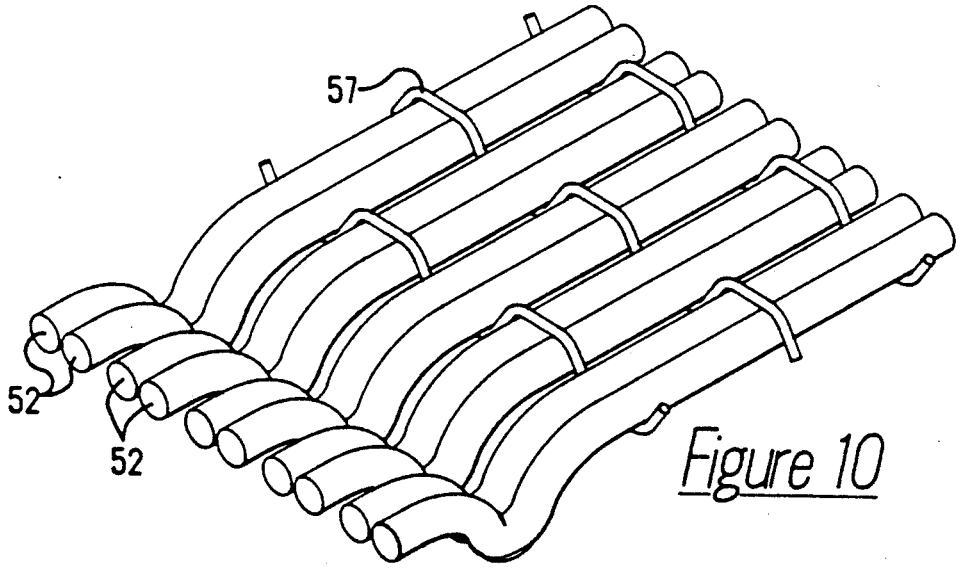
FIG. 10 is an end view of a cable of an alternative embodiment, similar to the cable of FIG. 8.

FIG. 10 shows an alternative version of the invention wherein pairs of wires 54 are employed side by side, a pair forming a single woof with the filament 57 being warped through pairs of wires. This construction provides a redundancy of not only wire improving reliability in the case of fracture of one of the wires, but reduces the overall resistance of a circuit and provides a redundancy of contact interface.

Figure 11:
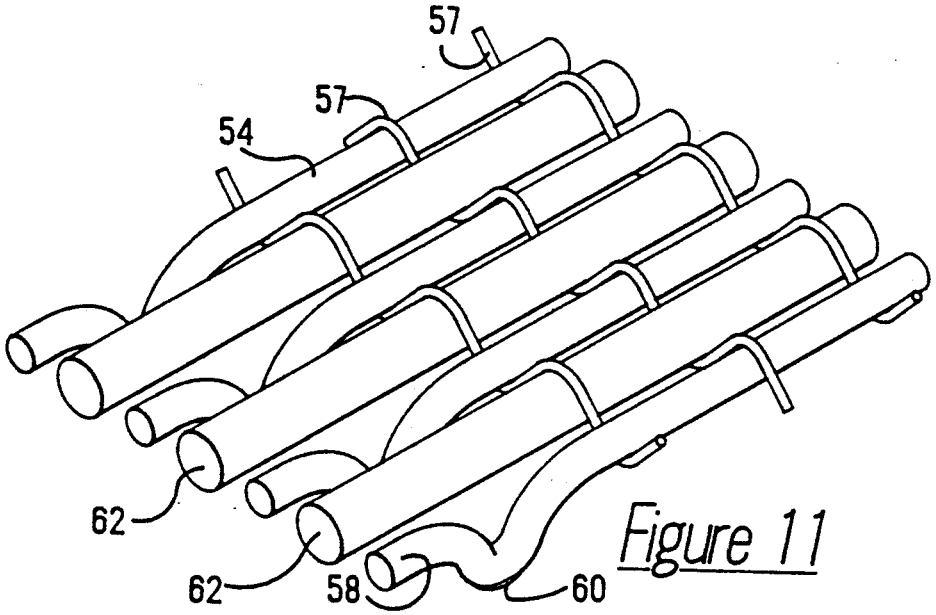
FIG. 11 is yet a further embodiment of the cable of the invention.

FIG. 11 shows an embodiment of the invention wherein the wires 54 are assembled as woof and in addition thereto, plastic insulating filaments 62 are spaced in between such wires and also assembled as woof. The filament 57 is warped between wires 54 and filaments 62 to bond the components together. The filaments 62 may be given a variety of diameters to form different constructions, the filaments serving to insulate the wires each from, the other, to provide a certain spacing therebetween, which may be useful in terms of controlling capacitance therebetween and the overall impedance of the wire. In this respect, it is contemplated that various wires 54 may be utilized for signal and other wires for ground to provide circuit isolation and to minimize cross-talk due to capacitive or other effects.

In functional prototypes, wires as small as on the order of 0.002 inches in diameter were woven to be on 0.004 inch centers utilizing 0.005 inch diameter polyester fiber warped therethrough approximately every 0.030 inches along the cable length. Other prototypes, including wires on the order of 0.005 inches in diameter placed on 0.010 inch centers and samples having wires on the order of 0.015 inches in diameter on 0.030 inch centers were fabricated. Prototype cables were formed of a phosphor bronze material of quarter hard material with a cast silicon such as Dow Chemical's Grilltex cast on one side of the cable and a polyester film on the order of 0.003 inches in thickness bonded thereto.

Figure 12:
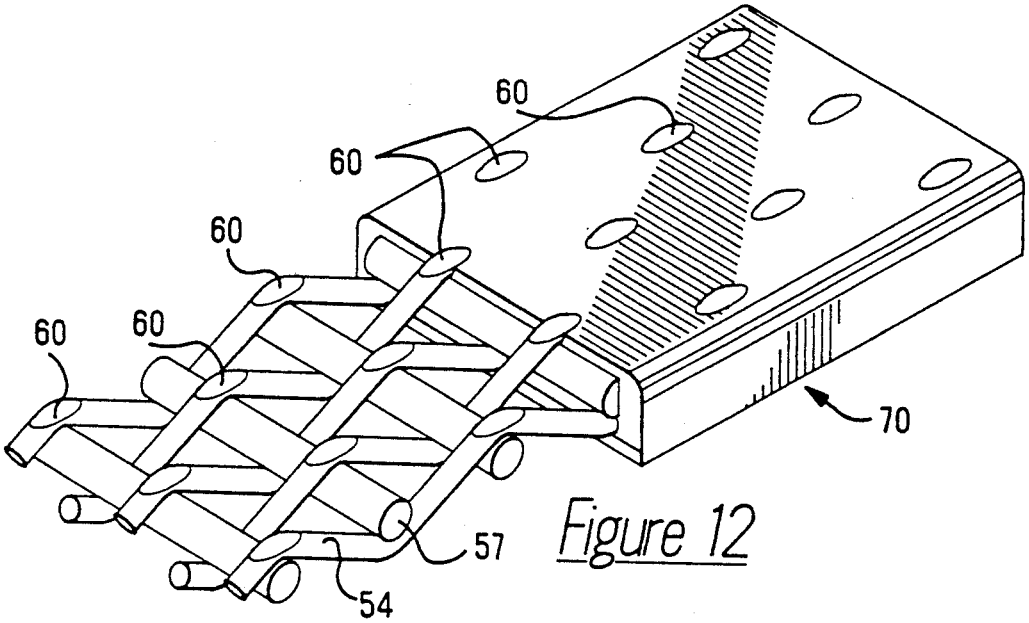
FIG. 12 is a perspective of an end view of a further embodiment of a cable of the invention.
Figure 13:
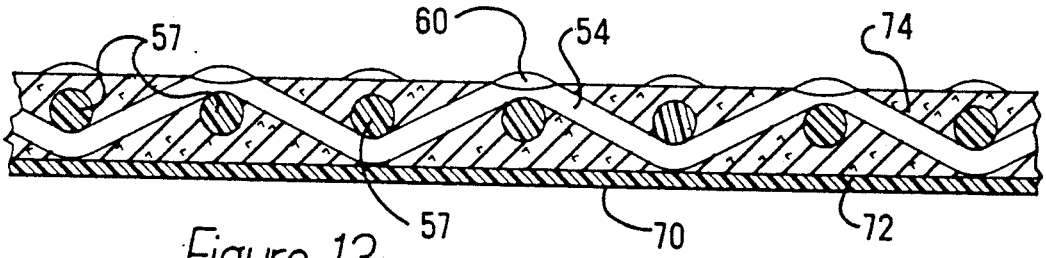
FIG. 13 is a sectional and elevational view of the cable shown in FIG. 12.
Figure 14:
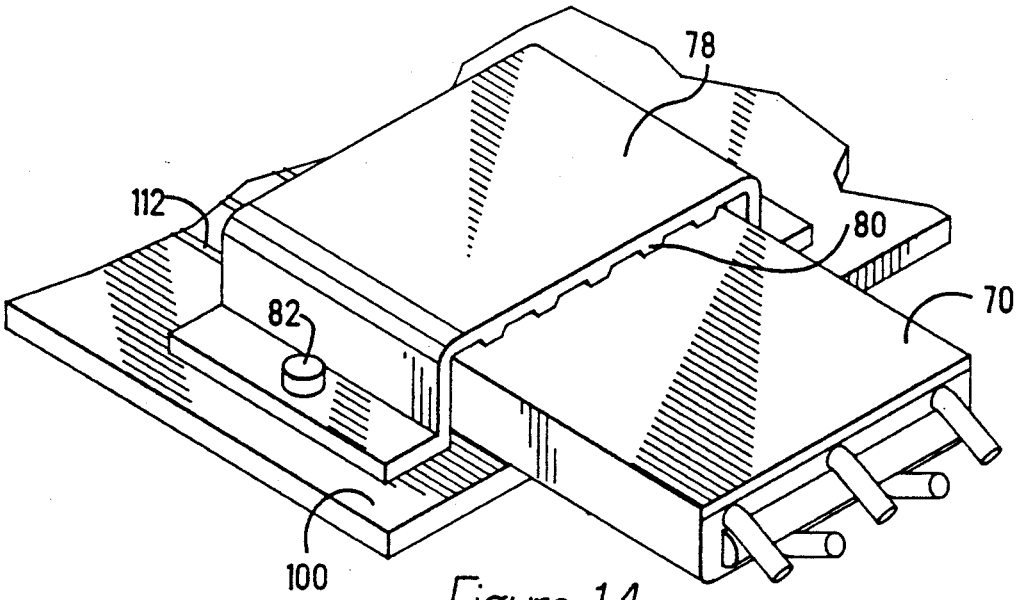
FIG. 14 is a perspective view of the cable shown in FIGS. 12 and 13 in use relative to a housing connecting the cable to a component.

FIG. 12 shows an alternative embodiment of the cable of the invention, 70, which is made to include wires 54 and plastic filaments 57, with the wires being formed as warp and the filaments as woof. FIG. 13 shows the side view of cable 70 and additionally shows a film cable covering 72 and a silicon embedment 74 holding the wires in position. As can be discerned from FIG. 13, the warping of the wires 54 is made to present contact points 60 exposed on one side of the cable. In use, a cable such as 70 may be forced down against contact pads such as on a printed circuit board or the equivalent having pads on centers comparable to those of the wires 54 or, alternatively, on centers with pad widths to accommodate a number of wires 54 per pad. FIG. 14 shows a cable 70 in relation to a printed circuit board 100 as heretofore described containing a series of pads 102 thereon and having a housing 78 forcing the cable 70 downwardly to cause the contact points 60 of the cable to bear against pads 102. The housing 78 includes a series of projections 80 which effectively clamp the cable to the board and generate the necessary normal force for effective stable low resistance interface. In this particular embodiment, the spring action of the individual wires 54 is accompanied by compression of the plastic fibers 57 as well as a slight compression of the film 72. Fasteners 82 lock housing 78 to the board. It is contemplated that a cable such as 70 may be employed to provide a high density jumper between two or more circuit paths such as defined on boards such as board 100.

Figure 15:
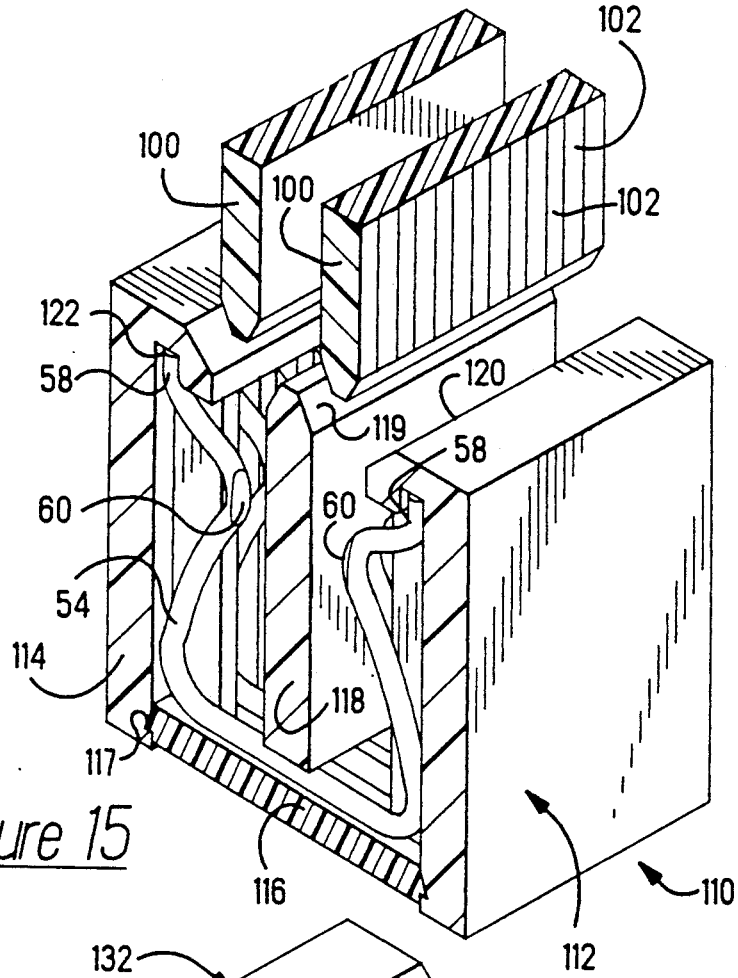
FIG. 15 is a perspective, partially sectioned, view showing an invention assembly in a housing preparatory to receiving component boards to be interconnected by the invention.

In FIG. 15, an alternative use of the cable heretofore described is shown with respect to interconnecting a pair of boards 100, each containing a series of conductive pads 102 which in turn would be connected to circuit traces and components on the boards. The boards 100 as shown in FIG. 15 poised prior to entry into a connector 110, which includes a housing 112 having side walls 114 and a bottom element 116 latched to the side walls through apertures therein 117 engaging end latches 117 of 116. The housing 112 further includes an upstanding central divider portion 118 beveled on both upper edges 119. The upper portions of the outer walls 114 are beveled inwardly 120, the beveling serving to guide the boards 100 within the connector. Internally and integrally formed with the outside walls 114 are grooves 122 adapted to receive in loose fitting engagement the ends 58 of wires 54 in the manner shown in FIG. 15. The wires 54 are formed into a general U-shape with the bend portions 56 directed inwardly to position the contact points 60 to engage pads 102 of boards 100 and be deflected by the thickness of the boards upon insertion and seating within the connector. In practice, with the bottom 116 removed, the preformed connector may be inserted within the walls 114 of the housing 112 and the bottom added to clamp the connector against the lower face of the portion 118. In practice, the portion 118 would be integrally molded with the walls 114 at the ends thereof.

Figure 16:
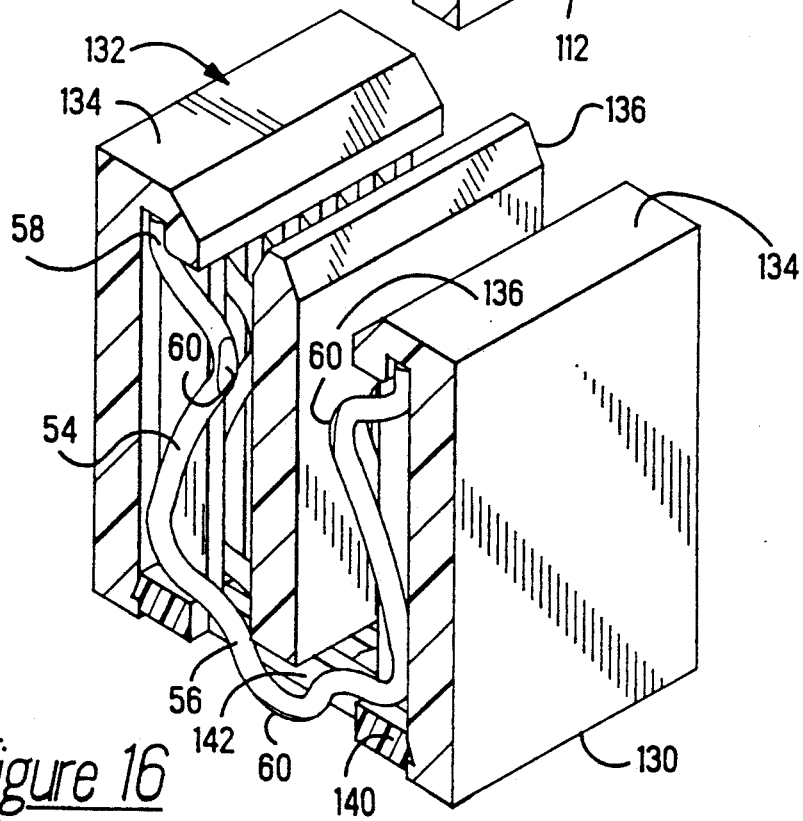
FIG. 16 is an alternative embodiment showing a housing containing an assembly of the invention modified to provide a three-way interconnection between component boards and a mother board.

FIG. 16 shows yet a further embodiment of the invention to include a connector 130 having a housing 132 including side walls 134 suitably beveled as in the previous connector. In this embodiment a central portion 136 is provided, also suitably beveled as previously described. The connector housing 132 includes a base plate 140 having a series of grooves 142 therein. These grooves accommodate a bend portion 56 resulting in a contact point 60 extending beneath and centrally of the housing 132 and the connector includes two additional contact points 60 or in it vertically to contact two pads such as 102 on boards 100. In the embodiment shown in FIG. 16, a pair of daughter boards such as 100 would thus be interconnected, one to another and to a mother board not shown which could contain contact paths engaging the contact point at the bottom of the housing 132. Means (not shown) would hold the connector housing 132 to the mother board.

Having now described the invention intended to enable those skilled in the art to practice preferred embodiments thereof, we set forth what is defined as inventive in the appended claims:

1. A cable for interconnecting electrical circuits on closely spaced center distances including a plurality of wires having diameters less than said center distances and insulating plastic members extending between said wires transversely to the cable length to engage opposite sides of adjacent wires effecting a weaving of said wires and members to hold said wires on said center distances for interconnection to said circuits, said wires being comprised of spring grade material and having portions thereof formed into spring beams at selected positions along the cable length, said spring beams extending outwardly from said cable and operable upon deflection thereof to engage said circuits on said center distances and provide an electrical connection between said wires and said circuits.

2. The cable of claim 1 wherein said wires are coated with a thin coating of a low oxidation material providing a stable electrical interface between said wires and said circuits.

* * * * *